United States Patent [19]

Roberts

[11] Patent Number: 4,612,606

[45] Date of Patent: Sep. 16, 1986

[54] APPARATUS FOR INDIRECT LIGHTING OF STAIRS

[76] Inventor: James R. Roberts, 4501 N. Western, Oklahoma City, Okla. 73118

[21] Appl. No.: 718,435

[22] Filed: Apr. 1, 1985

[51] Int. Cl.[4] ..... F21S 1/02

[52] U.S. Cl. ..... 362/146; 362/179

[58] Field of Search ..... 362/146, 217, 391; 52/179, 188

[56] References Cited

U.S. PATENT DOCUMENTS

| | | | |
|---|---|---|---|
| 2,756,323 | 7/1956 | Tusly | 362/146 |
| 3,885,144 | 5/1975 | Lewis | 362/146 |
| 4,143,411 | 3/1979 | Roberts | 362/146 |
| 4,318,951 | 3/1982 | Naka | 32/179 |
| 4,394,714 | 7/1983 | Rote | 362/146 |

FOREIGN PATENT DOCUMENTS

| | | | |
|---|---|---|---|
| 957345 | 1/1957 | Fed. Rep. of Germany | 52/179 |
| 2115451 | 9/1983 | United Kingdom | 52/188 |

OTHER PUBLICATIONS

European Patent Application—0082-482—Jun. 1983—Naka.

*Primary Examiner*—Ronald H. Lazarus

*Attorney, Agent, or Firm*—Laney, Dougherty, Hessin, Claro & Beavers

[57] ABSTRACT

An apparatus in the form of a stair nosing formation that is particularly adapted to provide an overhang for housing an indirect lighting source thereby to provide both functional and aesthetically appealing effects. The formation consists of a tread plate in perpendicular affixure to a riser plate while extending an overhang portion that is further formed into an overhang plate disposed parallel to the riser plate. A transverse plate is formed to extend between the overhang plate and riser plate to provide high structural strength while also defining a downwardly oriented channel for retention of an illumination source for directing light downward along the adjacent step riser toward the next lower step tread.

20 Claims, 3 Drawing Figures

APPARATUS FOR INDIRECT LIGHTING OF STAIRS

BACKGROUND OF THE INVENTION

1. Field of the Invention

The invention relates generally to apparatus for indirect lighting of stair steps and, more particularly, but not by way of limitation, it relates to improved forms of light housing extrusions for stair nosing applications that may or may not be utilized with carpet covering.

2. Description of the Prior Art

The prior art includes a great number of stair nosing structures of different types which may be utilized to reinforce and provide optimum tread surface in stair step applications; however, such prior nosing structures are not concerned with indirect lighting and the architectural aesthetics attendant the provision of indirect lighting to stairways and the like. An earlier form of indirect lighting housing for molded inclusion within step structures formed from cementitious materials or other moldable is the subject matter of U.S. Pat. No. 4,143,411 as issued on Mar. 6, 1979 in the name of Thomas E. Roberts and entitled "Architectural Lighting Apparatus". This patent teaches a specific extrusion form including bifurcation reflector extensions and lateral flanges for aiding in retention within a form molded material. The extrusion is formed to receive low voltage light tubing in indirect lighting disposition in various overhangs, stairs, or other indirect lighting applications. Related indirect lighting apparatus is disclosed in the co-pending U.S. Application Ser. No. 573,639 as filed on Jan. 25, 1984 in the name of James R. Roberts and entitled "Improvements in Architectural Lighting Apparatus", and the primary teachings of this application relate to extrusions enabling seating of light tubing for indirect illumination adjacent baseboard molding, ceiling molding and the like.

SUMMARY OF THE INVENTION

The present invention relates to an improved stair nosing structure that provides sturdy support across a tread riser outer corner while still providing a downwardly oriented channel for housing light tubing of the low voltage, high reliability type. The stair nosing structure may be extruded from suitable material as a unitary formation including a tread plate portion, riser plate portion connected thereto, and a forward-extending overhang plate portion forming a downwardly directed channel. The channel width, or spacing of the overhand portion from the riser portion, may be specifically formed to include space for a light tubing channel plus the terminus of pile carpet of predetermined thickness on each side thereof. A transverse plate extending generally perpendiculrly between the overhang plate and riser portion defines the base of the indirect lighting channel while also increasing the structural rigidity and overall strength of the stair nosing formation.

Therefore, it is an object of the present invention to provide a stair nosing formation having sufficient structural strength while still exhibiting the aesthetically desirable feature of providing an indirect lighting channel.

It is also an object of the present invention to provide a stair nosing structure that is capable of usage with diverse forms of stair covering or coating.

It is yet another object of the present invention to provide a stair nosing extrusion for indirect lighting that may be added to existing steps that have no overhang.

Finally, it is an object of the present invention to provide indirect lighting of stair treads at selected levels of illumination while still allowing use of carpet or other design-oriented coverings.

Other objects and advantages of the invention will be evident from the following detailed description when read in conjunction with the accompanying drawings which illustrate the invention.

DETAILED DESCRIPTION OF THE INVENTION

Figure 1:
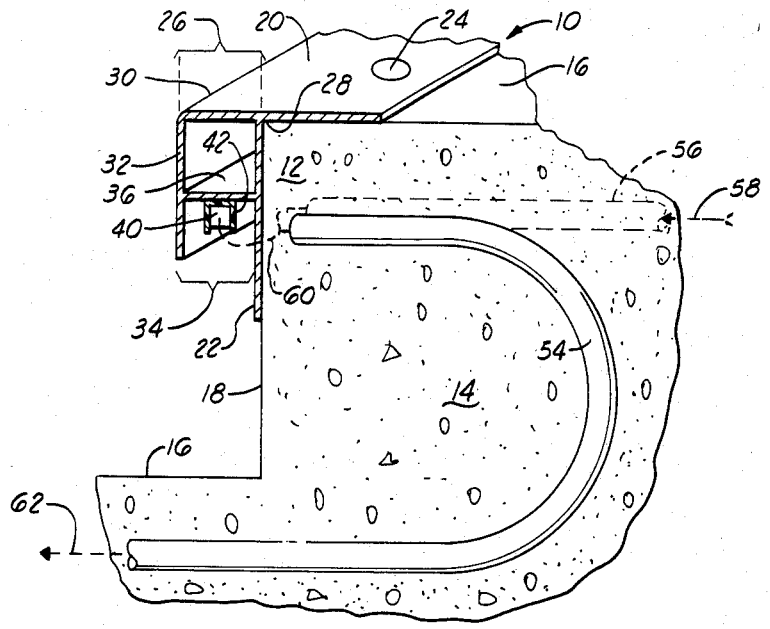
FIG. 1 is a view in vertical section of a first form of stair nosing formation as disposed on a stair step.

Referring to FIG. 1, a stair nosing formation 10 is rigidly secured on the outward corner 12 of a stair step 14. Stair step 14 consists of a tread portion 16 perpendicularly connected to a riser portion 18, successive ones of the stair steps being interconnected in similar dimension to effect the desired stair step slope. In the illustration, stair step 14 is shown as being formed of a molded, cementitious material such as concrete or other architecturally attractive material; however, the stair nosing formation 10 may just as easily be employed with stair steps of wood or other material construction so long as the necessary fastener or bonding allowances are made.

The stair nosing formation 10 consists of a first tread plate 20 of selected narrow width that may be any of various length dimensions, depending upon the width of conforming stair steps. A riser plate 22 is formed to extend perpendicularly from near the central portion of the narrow dimension of tread plate 20, and the angular configuration of tread plate 20 and riser plate 22 are adapted to be tightly fastened over outward corner 12 of stair step 14 by means of a plurality of suitable fasteners 24 and 26 (see also FIG. 2). In some cases, formation 10 may be installed using a suitable resin or bonding agent.

An outer overhang portion 26 of tread plate 20, of dimension consonant with the desired amount of overhand extending forward of riser 18, is accommodated forward of joinder 28 to the leading edge 30. A forward overhang plate 32 is then formed to extend from leading edge 30 generally parallel to riser plate 22 to define a downward facing channel opening 34. Increased structural strength is imparted to the forward portion of tread plate 20 by including a transverse plate 36 as connected between riser plate 22 and overhang plate 32 in generally parallel disposition to overhang portion 26 of tread plate 20.

The stair nosing formation 10 may be formed by any of various manufacturing methods, and it may be formed from any of selected materials that provide the necessary strength and rigidity in keeping with requisite safety requirements as used on stairway applications. Present experience indicates that extrusion of the formations 10 from metal such as aluminum provides a very efficient and economical method of manufacture.

Figure 2:
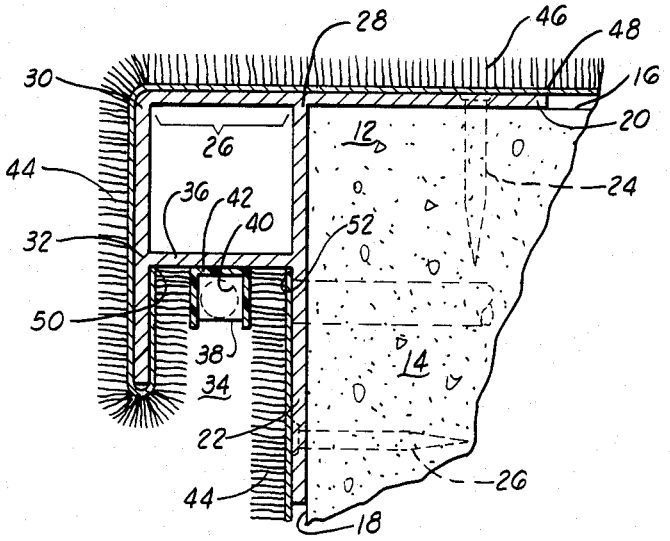
FIG. 2 is a view in vertical section of the stair nosing formation of FIG. 1 operatively disposed with carpet installed thereon.

Referring also to FIG. 2, a light source 38 is secured along the underside of transverse plate 36, generally centrally, to provide indirect lighting illumination downward along riser 18 to illuminate stair tread 16 or the associated covering. In preferred form, the light source 38 may consist of requisite lengths of high reliability, low voltage light tubing 40 as secured along the underside of transverse plate 36. Light tubing 40 may be selected from round or square type of selected diameter or width, and it is available in various colors and a range of designated unit lamp power per length ratings. The light tubing is a type that operates from a low voltage, e.g., 24-volt system, and one form is commercially available from Tivoli Industries, Inc. of Santa Ana, Calif.

Such light tubing 40 is constructed of LEXAN transparent tubular resin product which is particularly adaptable for its light transmissive properties as well as its flexibility for disposition along curves or other tortuous routing. Thus, it should be understood, too, that stair nosing formations may also be extruded in same cross-section but in various elongated curvilinear forms for application in specific architectural designs.

As shown in FIGS. 1 and 2, the light tubing 40 may be secured as by bonding within a U-shaped channel 42, a plastic or metal extrusion or the like, which channel in turn is bonded generally centrally along the underside of transverse plate 36 to direct light tubing 40 downward. The channel 42 serves to reflect and diffuse downward illumination while also providing an insulative or protective property in those applications wherein carpet covering is utilized along the stairways. Thus, as shown in FIG. 2, carpet 44 having pile 46 woven in backing 48 may be applied and bonded in conventional manner on the stair steps across each respective tread 16, tread plate 20, around leading edge 30 and around the bottom edge of overhang plate 32 such that a carpet terminus 50 is firmly bonded to the inside of overhang plate 32 adjacent light channel 42. A riser carpet terminus 52 is then secured on the opposite side of channel 42 on riser plate 22 to extend downward in bonded coverage along riser plate 22 and riser 18 for eventual coverage along the next lower step tread 16 and stair nosing formation 10. It may be noted that the width of overhang portion 26, and therefore transverse plate 36, may be adapted to allow for two thicknesses of the carpet 44 as bonded at carpet termini 50 and 52 with further allowance therebetween for the insulative and light directive channel 42.

Metal or plastic conduits or the like may be included internally within the stair step structures for routing of the various electrical wires needed in energization of the light tubes along successive stairs. Thus, as shown in FIG. 1, for the case of a cementitious molded stair step 14, a conduit 54 is secured within the step structure to extend from adjacent stair nosing formation 10 downward and outward to the next lower, adjacent stair nosing formation 10. In like manner, a conduit 56 leading downward from a previous stair nosing formation provides continuity from the electric power source 58. Thus, electric source connection, as shown generally by dash-line 58, may be run either series or parallel as required through various connections as at connection 60 and subsequent lower connection 62.

Figure 3:
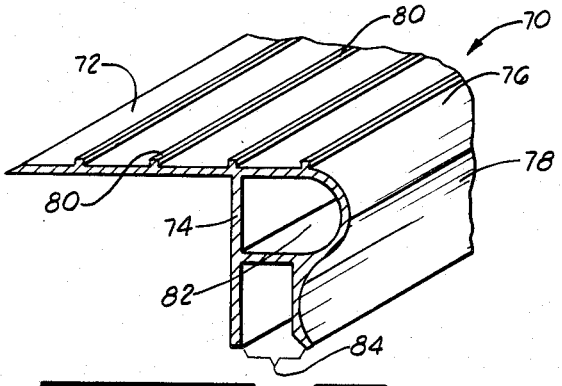
FIG. 3 is a modified form of stair nosing formation that may be more suitable for exterior and/or heavy traffic stair applications.

FIG. 3 illustrates another form of stair nosing formation 70 that is more readily utilized in those applications wherein carpet or other floor covering need not be accommodated. Thus, formation 70 consists of a tread plate 72 in connection with a riser plate 74, as tread plate 72 extends an overhang portion 76 that is shaped in aesthetically attractive manner to extend into an overhang plate 78 that extends generally parallel to the riser plate 74. The formation 70 may, of course, be formed to be as long as desired in order to provide stair nosing for requisite step width, and various tread grip formations 80 may be formed superficially thereacross. Additional strength and rigidity is achieved by inclusion of a transverse plate portion 82 secured between riser plate 74 and overhang plate 78 thereby also to form the downwardly oriented channel 84. In this case, the width of transverse plate 82, and therefore the proportionate width of downward focus of channel 84, is essentially the same as the light tubing diameter or width, depending upon whether it is a round or square type of tubing. Thus, the combination provides a very effective stair nosing structure with indirect illumination while requiring minimal overhang from the associated step riser portion.

The stair nosing formation 70 may be formed by methods and from materials in the same manner as formation 10 and the present approach utilizes continuous extrusion from a metal such as aluminum. In addition, the stair nosing formations 70 may be treated or colored by such as anodization in order to augment the aesthetic advantages.

The foregoing discloses a novel stair nosing structure that provides a high-strength corner formation while still defining a relatively narrow overhang for retention of indirect lighting means. The stair nosing formations are further differentiated for use in coaction with carpet or other stair covering materials, or as used in full exposure as may be particularly employed in outdoor applications in plazas, gardens or the like.

Changes may be made in the combination and arrangement of elements as heretofore set forth in the specification and shown in the drawings; it being understood, that changes may be made in the embodiments disclosed without departing from the spirit and scope of the invention as defined in the following claims.

What is claimed is:

1. Apparatus for use in indirect lighting of step treads, comprising:

first plate means for secure placement on at least the forward part of a step tread portion and extending a further forward edge beyond the step riser portion by a predetermined distance;

second plate means connected to said first plate means to extend for placement against the step riser portion immediately beneath said first plate means; and overhang plate means connected to extend from said first plate means forward edge parallel to said second plate means thereby to define a channel that is open in the direction generally parallel to said step riser.

2. Apparatus as set forth in claim 1 wherein:

said first plate means, second plate means and overhang plate means are a unitary formation.

3. Apparatus as set forth in claim 2 wherein:

said unitary formation is extruded metal.

4. Apparatus as set forth in claim 1 which further includes:

transverse plate means extending generally perpendicularly between said overhang plate means and second plate means at a position generally bisecting said overhang plate means thereby defining said channel therebeneath.

5. Apparatus as set forth in claim 4 wherein:

said first plate means, second plate means, overhang plate means and transverse plate means are a unitary formation.

6. Apparatus as set forth in claim 5 wherein:

said unitary formation is extruded metal.

7. Apparatus as set forth in claim 4 which further includes:

channel means disposed on said transverse means spaced from each of said second and overhang plate means and open downward along the adjacent step riser.

8. Apparatus as set forth in claim 4 which further comprises:

low voltage light tubing means secured beneath said transverse plate means.

9. Apparatus as set forth in claim 7 which further comprises:

low voltage light tubing means secured within said channel means.

10. Apparatus as set forth in claim 7 wherein:

said space on said transverse plate means on each side of said channel means is sufficient to allow termination of first and second carpet ends.

11. Apparatus for housing light tubing in order to provide indirect lighting of step treads, comprising:

stair nosing structure formed to include a tread plate having front and rear edges and a riser plate connected intermediate thereto between said front and rear edges and disposed at right angles said structure being adapted for placement in contact with a respective step tread and riser, and overhang plate means connected to extend from the front edge of the tread plate generally in parallel to said riser plate and spaced therefrom thereby to define a downwardly open channel for receiving said light tubing; and means for securing said tread plate and riser plate in placement in contact with said respective step tread and riser.

12. Apparatus as set forth in claim 11 wherein said stair nosing structure further includes:

a transverse plate affixed parallel to said tread plate and extending generally perpendicularly between said riser plate and overhang plate to form a base for said downward facing channel.

13. Apparatus as set forth in claim 12 wherein:

said stair nosing structure is a unitary metal extrusion.

14. Apparatus as set forth in claim 12 wherein:

said transverse plate is of a width sufficient to accommodate the carpet and pile terminus for each of the step tread and riser with remaining space therebetween for light tubing structure.

15. Apparatus as set forth in claim 14 wherein said light tubing structure comprises:

U-shaped channel means secured centrally to said transverse plate and open downward along the riser.

16. An apparatus for indirect lighting of steps having riser and tread, the combination comprising:

a stair nosing structure formed to include a tread plate having front and rear edges and riser plate connected thereto at right angles at a position intermediate said front and rear edges for placement against each of a respective step tread and riser, and having an overhang plate means disposed to extend from the front edge of the tread plate generally in parallel to said riser plate and spaced therefrom to define a downwardly open channel;

means for securing said tread plate and riser plate in placement against each of a respective step tread and step riser; and light tubing means secured within said downwardly open channel, and energizable to illuminate a respective step riser and tread.

17. Apparatus as set forth in claim 16 wherein said stair nosing structure further includes:

a transverse plate affixed parallel to said tread plate and extending between said riser plate and overhang plate to form the base of said downward facing channel.

18. Apparatus as set forth in claim 17 wherein:

said stair nosing structure is a unitary metal extrusion.

19. Apparatus as set forth in claim 18 wherein:

said transverse plate is of a width sufficient to accommodate the carpet and pile terminus for each of the step tread and riser with remaining space therebetween for light tubing structure.

20. Apparatus as set forth in claim 19 wherein said light tubing structure further comprises:

U-shaped channel means secured centrally to said transverse plate and open downward along the riser for receiving said light tubing means therein.

* * * * *